US005168281A

United States Patent [19]

Tokunaga

[11] Patent Number: 5,168,281

[45] Date of Patent: Dec. 1, 1992

[54] ANTENNA CONNECTION DEVICE FOR ELECTRONIC EQUIPMENT

[75] Inventor: Ikuo Tokunaga, Suwa, Japan

[73] Assignee: Seiko Epson Corporation, Tokyo, Japan

[21] Appl. No.: 700,666

[22] Filed: May 15, 1991

[30] Foreign Application Priority Data

May 16, 1990 [JP] Japan ..... 2-126145
Dec. 27, 1990 [JP] Japan ..... 2-407861

[51] Int. Cl.[5] ..... H01Q 1/12
[52] U.S. Cl. ..... 343/718; 343/906
[58] Field of Search ..... 343/718, 702, 906; 455/274, 344, 351

[56] References Cited

U.S. PATENT DOCUMENTS 4,947,179 8/1990 Ganter et al. ..... 455/351
4,977,614 12/1990 Kurcbart ..... 455/274

FOREIGN PATENT DOCUMENTS 0279054 8/1988 European Pat. Off. .
0308935 3/1989 European Pat. Off. .
0169401 12/1981 Japan ..... 343/718
0181203 8/1986 Japan ..... 343/798

*Primary Examiner*—Michael C. Wimer
*Assistant Examiner*—Tan Ho
*Attorney, Agent, or Firm*—Raymond J. Werner

[57] ABSTRACT

An antenna connection device structure for physically and electrically connecting a wristband-embedded antenna to a wristwatch-type receiver is disclosed. A receiver and leaf spring mounted in a casing having an opening, are joined to a wristband-embedded antenna having a connection terminal, by means of a connector. The connector, which has two ends, fits within and extends through said opening so that it closes the opening in a water-tight fashion and makes electrical contact with said leaf spring. The other end attaches to a connection terminal of the wristband-embedded antenna.

17 Claims, 3 Drawing Sheets

$ØD_3 = ØD_1 + 0.3$ mm $ØD_1 < ØD_2 < ØD_3$ $ØD_2 - ØD_1$ = RADIAL INTERFERENCE (BOTH SIDE)

ANTENNA CONNECTION DEVICE FOR ELECTRONIC EQUIPMENT

BACKGROUND OF THE INVENTION

The present invention relates generally to an antenna connection device for portable electronic equipment, such as, wristwatch-type pagers, radios, and televisions. More particularly, this invention relates to an antenna connection device structure wherein a wristband-embedded antenna may be removably attached to portable electronic equipment while maintaining a high degree of water-resistance, durability and strength.

Portable electronic equipment, such as, wristwatches with built-in receivers, often require antennas for proper operation. One previous antenna connection device structure useful for attaching an antenna to a wristwatch-type receiver required molding of a lead-wire antenna into the case of the wristwatch/receiver. Another previous antenna connection device structure required that the lead-wire be introduced to the inside of the case through an insulator.

These structures did not provide the desirable qualities of water-resistance, solid body strength and durability. Inadequate water-proofing of the connection between the antenna and the receiver has been a problem. Previous antenna connection structures have made use of plated copper or plated copper alloys but they provide poor corrosion resistance, particularly where corrosion is accelerated by the presence of perspiration or sea water. These previous antenna connection structures have also created difficulties with respect to ease of attachment and detachment of the wristband due to the complex antenna connection devices. Previous antenna connection structures for these wristband-embedded antennas have also resulted in wristbands with poor mechanical characteristics, particularly poor tensile stress, twisting stress, and bending stress characteristics.

Therefore, a need exists for an antenna connection device suitable for use with portable electronic receivers, wherein an antenna may be connected to a receiver in such a way that desirable physical characteristics, such as body strength and water-resistance, are achieved. There further exists a need for an antenna connection device which provides for a wristband-embedded antenna having good tensile stress, twisting stress and bending stress characteristics, that is also easy and simple to attach and detach.

SUMMARY OF THE INVENTION

It is an object of the present invention to provide an antenna connection device structure which provides for the qualities and characteristics, such as a high degree of water-resistance, corrosion resistance, solid body strength, and durability, not previously obtainable.

It is a further object of the present invention to provide an antenna connection device structure which results in a wristband-embedded antenna having good tensile stress, twisting stress and bending stress characteristics.

Accordingly, the present invention provides an antenna connection device structure for connecting a wristband-embedded antenna to a wristband-type receiver. The preferred embodiment comprises a casing which houses a receiver, a wristband-embedded antenna plate, and a connection means for physically connecting the wristband to the casing, and simultaneously electrically connecting the antenna to the receiver.

The casing is preferably made from an electrically non-conductive material. The casing is provided with a hole, or opening, in at least one side to facilitate the physical connection between casing and wristband, and the electrical connection between the receiver and the antenna. This opening has chamfered surfaces which interact with the packing ring to provide a water-tight connection. The antenna is preferably embedded in a wristband made from an electrically non-conductive material.

The connection means utilizes a contact spring, a connector, connector packing, attachment screws and a connection terminal to make the above-described physical and electrical connections.

The connector is specially shaped so that it may: 1) fit into and through the casing opening in a water-tight manner, 2) make physical and electrical connection with the contact spring, 3) receive the connection terminal to make a physically strong and electrically conductive connection.

To assemble the structure of the present invention, the connector is mounted in the casing such that it is fitted into and extends through the opening in the casing so that it pushes against a resilient conductive member or contact spring. The connector has a packing groove in which a connector packing is inserted. The contact spring is disposed between the connector and a receiver housed in the casing, thus establishing electrical connection between the receiver and the connector.

A specially-shaped connection terminal serves as a means to attach the wristband to the connector. The connection terminal has two ends, one of which is attached to a wristband-embedded antenna. The other end of the connection terminal is received by, and fixed to, the connector to make a physically strong and electrically conductive connection. Attachment screws are used to ensure a durable connection to the casing.

The connection terminal is characterized by being constructed so that it attaches to and detaches from the casing by means of a fixing member such as attachment screws.

The antenna plate, the connecting terminal and the connector, are made of a highly corrosion resistant alloy such as stainless steel.

An advantage of the present invention is that the water-tight performance has increased markedly. The two atmospheres of water-tightness achieved by previous structures has been increased to between five and ten atmospheres, greatly increasing the range of applications in which portable electronic equipment such as wristwatches can be used.

A further advantage of the present invention is a reduction in the staining of shirts that comes about due to the corrosion of the copper-alloy-plating structure used previously for a variety of contacts. Because the antenna plate, connection terminal and connector are all fabricated from highly corrosion resistant SUS material, corrosion has been eliminated, and a major problem affecting product marketability has been resolved.

A further advantage resulting from the present invention is a higher level of mechanical strength in the connection between the casing and the wristband antenna. In particular the tensile, twisting, and bending strength have been improved.

A further advantage of the present invention is that the number of parts has been reduced, compared to prior art devices thus lowering manufacturing costs. Further, the casing and band can be injection molded, allowing for an excellent mass production capability.

A further advantage of the present invention is an increase in design freedom, particularly the external appearance design. The large practical effect, such as allowing a design that makes the casing and band appear to be a single unit, comes about because the band attachment area is the screw stop and the wristband is fixed firmly to the casing without any gaps.

DETAILED DESCRIPTION OF THE INVENTION

Figure 1:
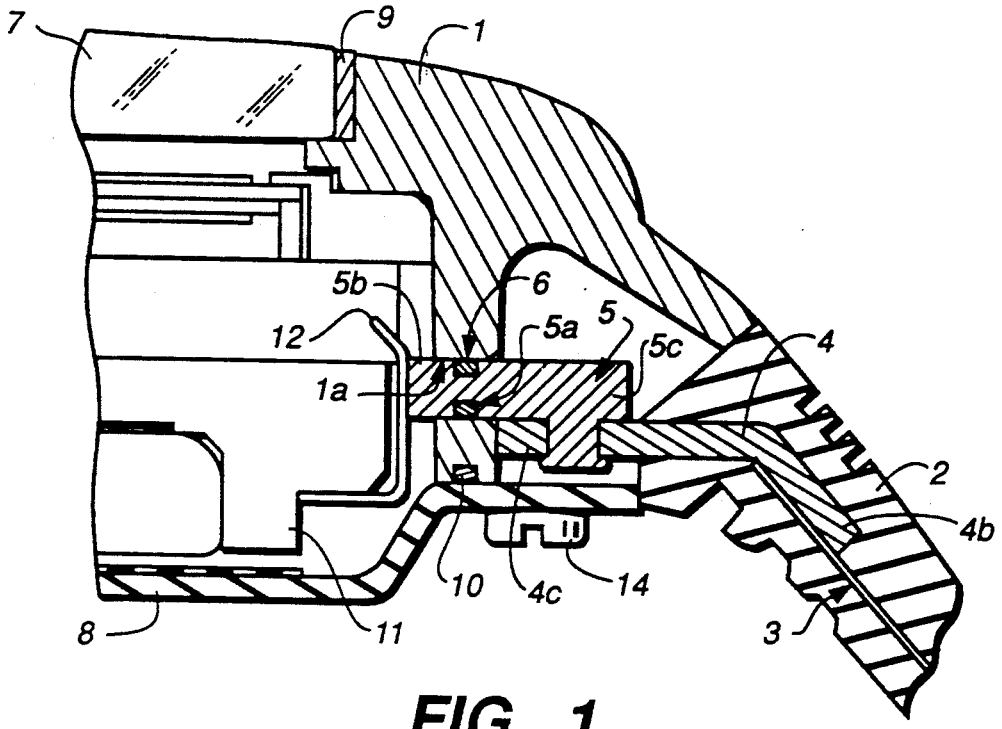
FIG. 1 is a partial cross-section of the connecting areas of one embodiment of this invention.
Figure 2:
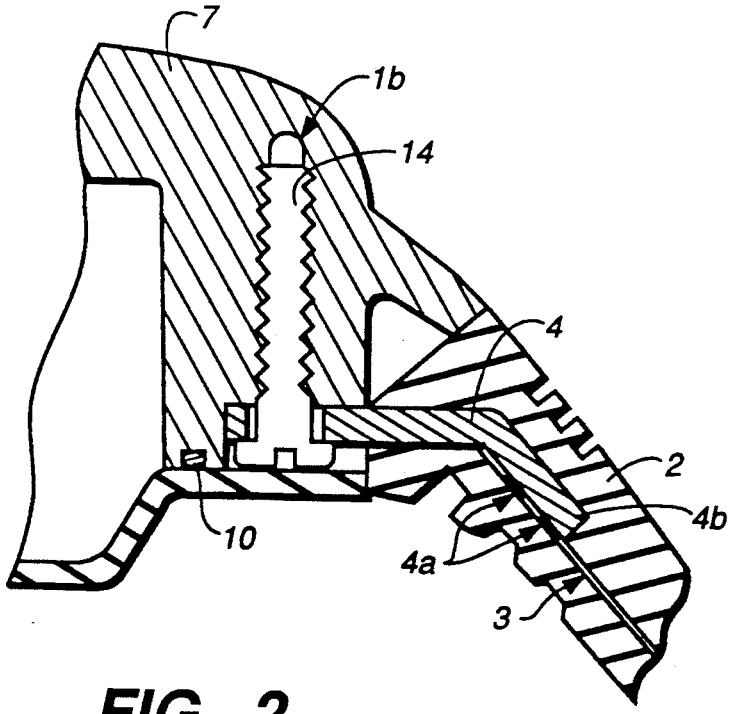
FIG. 2 shows a cross-section of the fastening areas of one embodiment of this invention.
Figure 3:
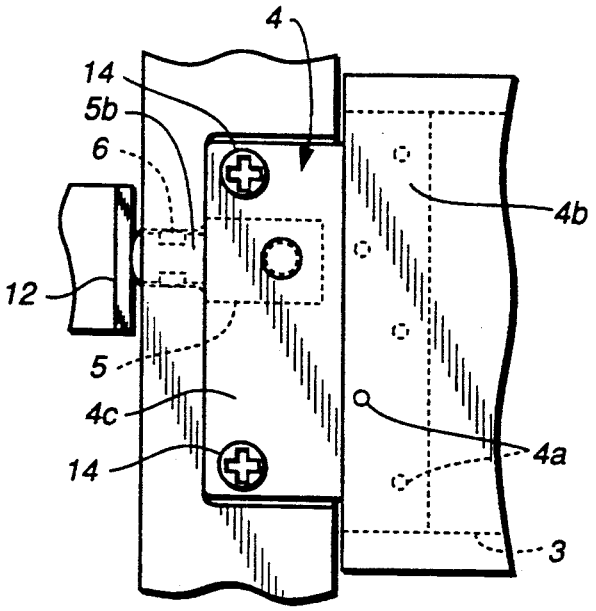
FIG. 3 is a plane diagram of the connecting areas and fastening areas of one embodiment of this invention.
Figure 4:
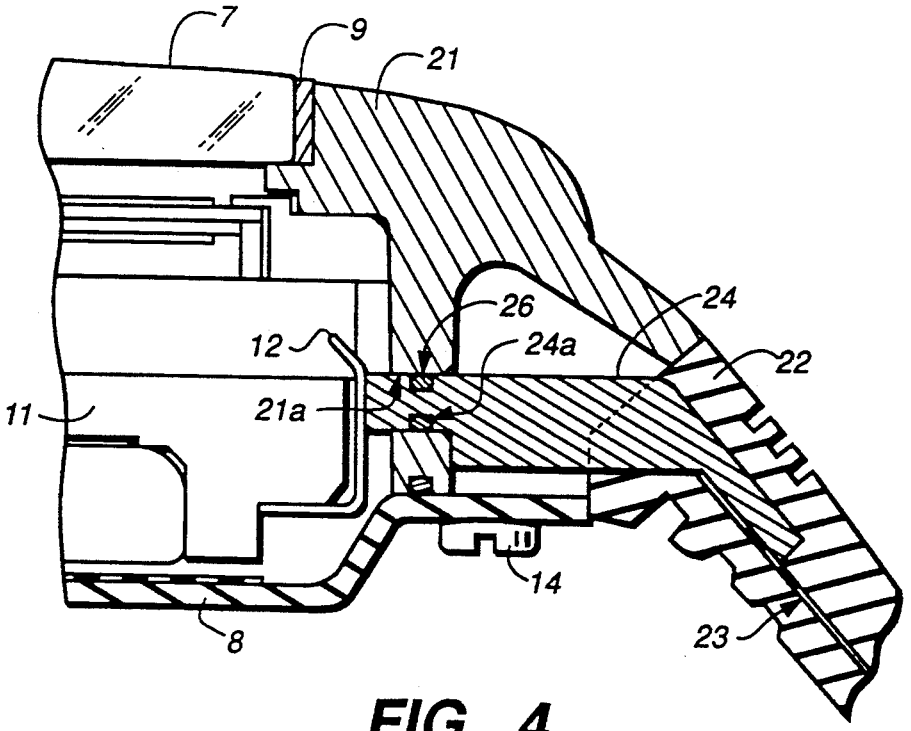
FIG. 4 is a partial cross-section of the connecting areas of an alternative embodiment of this invention.
Figure 5:
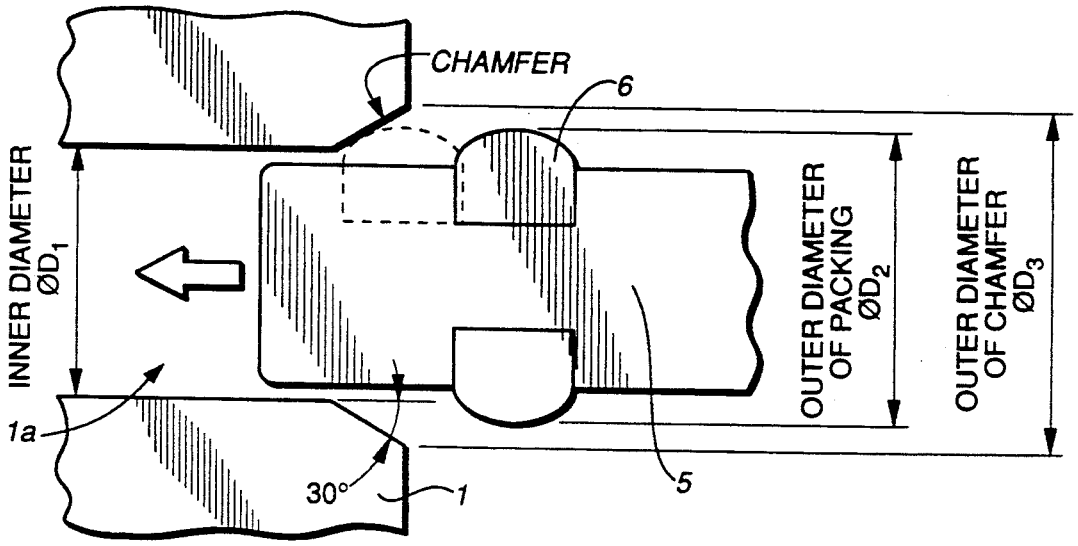
FIG. 5 shows the relation between the chamfered guide surface, the connector packing and the connector.

A detailed description of the embodiments is presented with reference to the drawings wherein FIGS. 1–3 represent one embodiment, FIG. 4 represents a second embodiment, FIG. 5 is common to both described embodiments and like reference numerals designate like parts throughout the figures.

THE COMPONENTS

Casing 1, shown in FIG. 1, is made from a hard plastic such as a polycarbonate resin containing glass fibers, and has a hole, or opening 1*a*, in at least one side to facilitate the physical connection between casing and wristband, and the electrical connection between receiver and antenna. It will be understood by those skilled in the art that a transmitter circuit may be housed within the casing just as easily as a receiver circuit. Opening 1*a*, provides chamfered guide surfaces through which connector 5, with connector packing 6 already mounted thereon, will be smoothly inserted. FIG. 1 also shows the casing front wherein cover glass 7 has been pressed into place through water-tight gasket 9 so that cover glass 7 is water-tight. Cover glass 7 is preferably made of an inorganic glass and water-tight gasket 9 is preferably made of a synthetic resin. Back cover 8 is removably attached, over back cover packing material 10, to the back of the casing by means of screws 13. The back cover packing may be an O-ring, although no waterproofing problems are found with D or F type rings. Back cover 8 is preferably made from a stainless steel material and the back cover packing material 10 is preferably made of synthetic rubber.

An internal receiver 11, such as one that would be used for a pager, a radio or a television is installed inside the casing. A contact, or resilient conductive member 12, functioning like a leaf spring, is installed within casing 1 such that it is in electrical contact with receiver 11 and is physically adjacent to opening 1*a* in casing 1. Resilient conductive member 12, being a leaf spring, makes biased connection and contact with connector 5 inserted in opening 1*a*. Resilient conductive member 12 is secured mechanically at the peripheral portion of receiver 11 and is connected electrically by contacting the circuit board inside the receiver.

Antenna plate 3 has a thickness of 0.05 mm to 0.2 mm and a width of 10 mm to 17 mm. Preferably antenna plate 3, has a low resistance to high frequencies and is made of a stainless steel material that has good corrosion resistance, such as SUS304. Connection terminal 4 is attached, by means of spot welding, to the one end of antenna plate 3 prior to the wristband being formed around antenna plate 3. The connection terminals are made from the same type of stainless steel as antenna plate 3.

SUS means stainless steel according to the JIS code. The following table compares the JIS code and the ASTM, AISI codes of the United States:

| JIS | ASTM, AISI |
|---|---|
| SUS 304 | AISI 304 |
| SUS 316L | AISI 316L |

Wristband 2 is made of a synthetic rubber such as polyurethane rubber or silicon rubber. Antenna plate 3 is insert-molded in wristband 2 and is a single unit in order to make bending possible. An antenna plate made of stainless plate material could easily be bent or broken when used by itself. However, when it is formed with rubber, its quality is improved, and the combined structure can be bent flexibly because stress is dispersed in the rubber part.

Connection terminals 4 each having a flat portion and an angled portion, are made of the same type of stainless steel material as antenna plates 3. The angled portion is the same width as the antenna plates 3.

The angle between the flat portion and the angled portion of connection terminal 4 is determined as a function of the size of the case and the cross sectional size of a human wrist. If the case size is large, the angle is large. If the case is small, the angle is small and the angled portion reaches closer to the horizontal plane of the flat portion. A large human wrist requires that the angle be small (i.e. reaching toward the horizontal plane of the flat portion). A small wrist requires the angle to be larger to accommodate the quick drop-off from the casing to the sides of the wrist. The bending angle is preferably set in the range of about 30° to about 60°.

Connector 5 has a first portion 5*b* and a second portion 5*c*, wherein said first portion 5*b* is mounted in casing 1 through opening 1*a*, and the second portion 5*c* receives wristband connection terminal 4. Connector 5 is specially shaped so as to receive connection terminal 4.

Packing groove 5*a* is formed on first portion 5*b* of connector 5. There is no corresponding groove on case 1. Connector annular packing 6, which is preferably made of synthetic rubber, is an annular sealing ring to seal the gap formed between packing groove 5*a* and casing opening 1*a*.

THE ASSEMBLY

The angled portion of each connection terminal 4 is spot welded to antenna plates 3 to form a subassembly. Antenna plate 3 and connection terminal 4, after being formed into a single unit by spot welding, are set in a mold and wristband 2 is completed by the liquid injection molding of a synthetic rubber, such as, polyurethane rubber or silicon rubber.

The exposed end, i.e. the flat portion, of connection terminal 4 and connector 5 are attached so as to form a single unit by means of a mechanical connection. Once the mechanical connection between connector 5 and connection terminal 4 has been made, electrical connection is achieved by caulking or welding. Alternatively connection terminal 4 and connector 5 may be connected together through a stainless steel process such as metal injection molding.

FIG. 2 shows a cross section of that part of wristband 2 that is removably attached to casing 1 in the manner of the present invention. Antenna plate 3, which is insert-molded into the wristband, is fixed permanently into place in a manner that allows 20 kilograms or more of pulling force to be obtained by the non-linear spot welding of three to six places 4*a* on lower surface of angled section 4*b* of connection terminal 4. Antenna plate 3 and connecting terminal 4, thus form a single unit in the assembly and are covered by the synthetic rubber wristband. However, one end 4*c* of connection terminal 4 is exposed and that end is fixed to casing 1. The attachment of wristband 2 to casing 1 is accomplished by wristband attachment screws 14 which make a secure connection and also provide for removal of wristband 2 when necessary. Wristband attachment screws 14 are preferably self-tapping screws.

As shown in FIG. 3, wristband attachment screws 14 are provided in two locations, one on either side of connector 5, in a symmetrical arrangement transversely to the elongated extent of casing 1. The width of antenna plate 3 is the same as that of the spot welded section 4*b* of connection terminal 4, simplifying alignment during spot welding of these two components. There are a number of spot welds 4*a*, but they are not formed in co-linear fashion but are formed in an offset fashion. They are divided into two rows to provide strength. According to tests conducted, this type of connection configuration has provided a tensile strength in the range of 20 kilograms to 40 kilograms. Tensile strength in this range has been determined to be adequate for application in a wristwatch-type band with a built-in antenna. The standard tensile strength of wristwatch bands is in the range of 10 kilograms to 15 kilograms when measured by pulling both ends. Thus the structure of the present invention provides an improved safety margin.

Connector 5 and connection terminal 4 are preferably fixed in place by caulking. Caulking is a mechanically performed permanent securing process. In this case, after the axis of connector 5 is set in the aperture of connection terminal 4, plastic deformation is performed on the tip of the axis to make it larger than the diameter of the aperture so that it is permanently secured. However, their mechanical strength and electrical properties will last for a long period of time if they are soldered together.

The permanent securing of connector 5 and connection terminal 4 either by means of caulking or soldering is performed before wristband 2 is removably secured to casing 1 by attachment screws 14. Wristband 2, antenna 3, connection terminal 4, connector 5 and packing 6 are assembled as one unit and then mounted on casing 1.

AN ALTERNATIVE EMBODIMENT

FIG. 4 shows another embodiment of the present invention. In contrast to the embodiment of FIG. 1, this embodiment features connection terminal 4 and connector 5 being manufactured as a single-unit, or integral, connection terminal 24 so that greater thinness and compactness of this component is achieved. In addition to improving long-term electrical reliability, this structure permits reduction in manufacturing and assembly costs since there is a reduction in the number of parts.

In this alternative embodiment, one end of single-unit connection terminal 24 is connected to antenna plate 23, which is embedded in wristband 22. The other end of single-unit connection terminal 24 is constructed with manufacturing tolerances such that a water-tight connection is formed by the placement of connection terminal 24 surrounded by connector annular packing 26 in packing groove 24*a* into opening 21*a* of casing 21. Connector packing 26 is placed in annular packing groove 24*a* formed on connection terminal 24 so that opening 21*a* is water-tight after insertion of connection terminal 24 therein. In addition, connector terminal 24 may be made by means of a metal injection molding process of a material such as SUS316L or SUS304.

CONCLUSION

In the case of a wristwatch-type receiver, the structures described above allow for a wristband with separate built-in antenna plates at the 12 O'clock and 6 O'clock positions. Such a band will function as a loop antenna, enhancing the reception effect.

While the invention has been described in conjunction with several specific embodiments, it will be clear to those skilled in the art, that many alternatives, modifications and variations are possible in light of the foregoing description. For example, the present invention has been described in terms of a wristband being used as an antenna for a miniature wristwatch-type receiver. However, the present invention may also be applied to the antenna connections of other portable electronic equipment, such as a pocket watch or a pendant-type device in a configuration that uses a wristband-type antenna on one side or on both sides. The present invention is applicable to transmitter equipment as well as receiver equipment. The specific embodiments described are illustrative of the present invention and not intended as limitations. Thus, the invention described herein is intended to embrace all such alternatives, modifications, variations and applications as fall within the spirit and scope of the subjoined claims.

What is claimed is:

1. An antenna connection device for electronic equipment having a casing and connected wristband comprising:

a) an opening formed in at least one side of said casing, said casing comprising an electrically insulating material;

b) a wristband comprising an electrically insulating material in which is buried an antenna plate that is the antenna for said electronic equipment;

c) a conductive connection terminal for coupling to said antenna plate;

d) a conductive connector having a circumferential groove and two ends with one end connected to said connection terminal and the other inserted through said opening; and e) a connector packing, sealingly disposed between said groove and said casing.

2. The antenna connection device of claim 1 wherein said connection terminal is constructed so that it attaches to and detaches from said casing by means of a fixing member.

3. The antenna connection device of claim 1, wherein said antenna plate, said connection terminal and said connector are comprised of a highly corrosion resistant material.

4. The antenna connection device of claim 3, wherein said highly corrosion resistant material is stainless steel.

5. An antenna connection device for electronic equipment comprising:

a) a casing having an opening in at least one side;

b) a wristband further comprising an antenna plate embedded within said wristband and further comprising a connection terminal connected to said antenna plate;

c) a connector having a first portion and a second portion, wherein said first portion is mounted in said casing and has a circumferential groove, and said second portion detachably receives said wristband connection terminal; and d) a connector packing, sealingly disposed between said groove and said casing.

6. The device of claim 5, wherein said casing is comprised of an electrically insulating material.

7. The device of claim 5, wherein said wristband is comprised of an electrically insulating material.

8. The device of claim 6, wherein said electrically insulating material is a synthetic resin.

9. The device of claim 7, wherein said electrically insulating material is a synthetic rubber.

10. The device of claim 5, wherein said antenna plate, said connection terminal and said connector are comprised of a corrosion resistant material.

11. The device of claim 10, wherein said corrosion resistant material is stainless steel.

12. The device of claim 5, wherein said connector further comprises a packing groove formed in said first portion.

13. An antenna connection device for electronic equipment comprising:

a) a casing having an opening in at least one side;

b) an electronic circuit housed in said casing;

c) a wristband having an antenna plate embedded within said wristband;

d) a means for connecting said wristband to said casing and said antenna plate to said circuit, said means having a circumferential groove;

e) a resilient conductive member connected to said circuit and engaged by said means for connecting; and f) a connector packing, sealingly disposed between said groove and said casing.

14. The device of claim 13, wherein said opening has chamfered inner surfaces.

15. The device of claim 14, wherein said means for connecting comprises a single-unit connection terminal having a first end and a second end, and a bend formed intermediate said first and second ends which produces a first portion from said first end to said bend, and a second portion from said bend to said second end.

16. The device of claim 15, wherein said single-unit connection terminal further comprises a packing groove formed in said first portion.

17. The device of claim 16, wherein said single-unit connection terminal is attached to said antenna plate.

* * * * *